United States Patent [19]

Massino

[11] 4,337,944

[45] Jul. 6, 1982

[54] LIGHTER AND SOFTER RECREATIONAL BALLS

[75] Inventor: Chester F. Massino, Sandwich, Ill.

[73] Assignee: Ideas That Sell, Inc., Sandwich, Ill.

[21] Appl. No.: 203,136

[22] Filed: Nov. 3, 1980

Related U.S. Application Data

[63] Continuation-in-part of Ser. No. 29,316, Apr. 12, 1979, Pat. No. 4,241,918.

[51] Int. Cl.[3] ..... A63B 41/08; A63B 45/00; A63B 37/02

[52] U.S. Cl. ..... 273/65 A; 273/65 EG; 273/DIG. 20

[58] Field of Search ..... 273/60 R, 60 A, 60 B, 273/58 A, 65 EC, 65 ED, 65 EF, 65 EG, DIG. 20

[56] References Cited

U.S. PATENT DOCUMENTS 3,708,170 1/1973 Presnell ..... 273/65 EG X
4,241,918 12/1980 Massino ..... 273/DIG. 9 X

*Primary Examiner*—George J. Marlo
*Attorney, Agent, or Firm*—Leydig, Voit, Osann, Mayer & Holt, Ltd.

[57] ABSTRACT

A ball having the general appearance, shape and aerodynamic characteristics of a conventional football when thrown or kicked; but which is softer and lighter allowing for its use in congested areas—it does not travel as far when thrown or kicked—and by younger children who are more susceptible to injury with a conventional football. The ball is comprised of a waste acrylic yarn interior or center having a wool or felt batting inner cover and a four-piece polyester double-knit outer cover. The ball preferably has a simulated lacing along an intermediate portion of one of the seams to resemble a conventional football in this sense and overlapping panel edges where the simulated lacing is present provide an elevated or raised ridge for gripping the ball thereby enhancing its throwing characteristics. In a spherical ball, eight pieces of wool or felt are secured to each other to provide an interior cover, and eight pieces of a polyester double knit fabric are secured to each other and the inner cover to provide an outer cover.

7 Claims, 7 Drawing Figures

FIG. 4
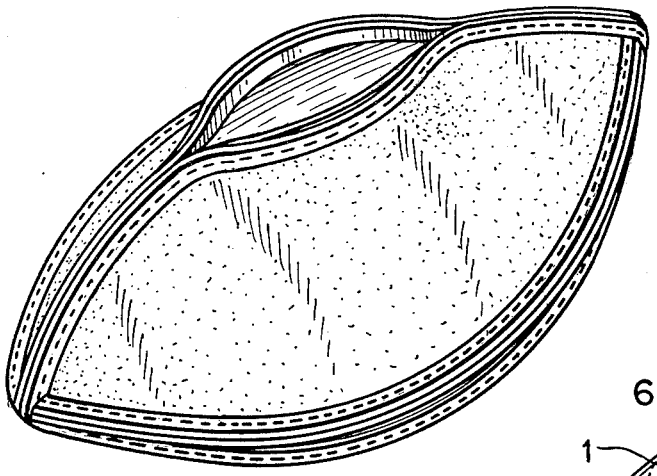
FIG. 5
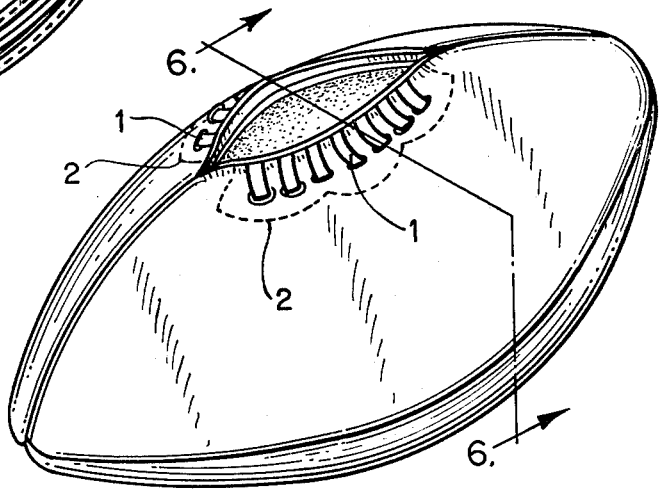
FIG. 6
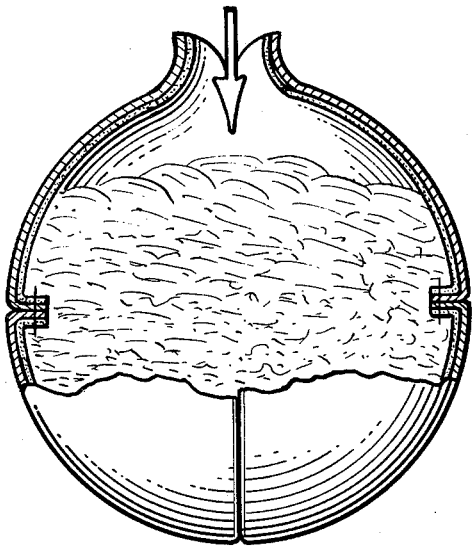
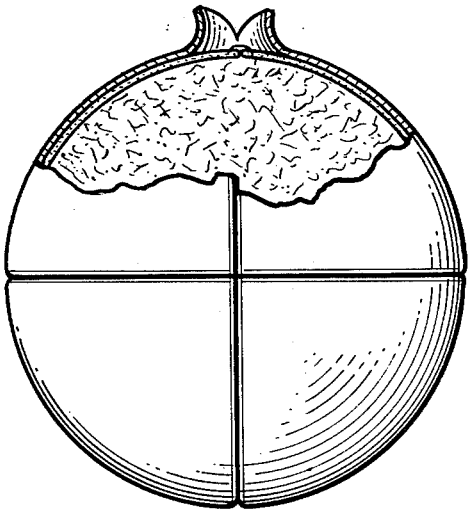
FIG. 7

LIGHTER AND SOFTER RECREATIONAL BALLS

CROSS REFERENCE TO RELATED APPLICATIONS

This application is a continuation-in-part of my U.S. application Ser. No. 029,316, filed Apr. 12, 1979, now U.S. Pat. No. 4,241,918.

BACKGROUND OF THE INVENTION

This invention relates to a ball, more particularly to a ball which can be substituted for a conventional football where space is limited, where the players are more susceptible to injury by the use of a hard ball such as a football or where the surrounding property is susceptible to damage, e.g., windows.

A conventional football has a relatively hard form and is potentially injurious to young children just learning to play the game as well as being difficult for them to grip. The need for a lighter, softer and potentially less dangerous ball has long been recognized by the sporting industry. Various alternatives such as balls made of polyurethane foam, plastic or the like have been manufactured but have met with only limited success. While these lightweight balls have been used, they have not had a great degree of success because the characteristics of these substitutes have been substantially different from the conventional football, i.e., in general they have not been capable of being thrown with a spiral and accordingly the aerodynamic characteristics of a conventional football have not in general been obtained by these substitutes. Additionally, the durability of some of these balls is less than desirable.

A lighter, softer and less dangerous ball which would still have the characteristics of a conventional football then would be of substantial benefit to the sporting public for the following reasons:

1. The technical skills required to play the game well would still be required;
2. The playing field size could be reduced substantially since the ball could not be thrown or kicked as far; and
3. There would be less danger to the participants and to the surrounding property. This would be of particular benefit to young children just beginning to play the game.

My parent application, U.S. application Ser. No. 029,316, filed Apr. 12, 1979 (presently allowed) is directed to balls having the characteristics described above. It has now been found that a firmer and more durable ball than that obtained using the fill material disclosed in the parent application—while still being softer than a conventional football, basketball, soccer ball or the like—can be obtained by utilizing a different fill for the interior or center of the ball.

The subject invention is directed to such a ball and a method of making it.

SUMMARY OF THE INVENTION

According to the invention a ball noticeably lighter and softer than a football but having the general appearance, shape and characteristics of a football (particularly the aerodynamic characteristics) is provided. The ball is comprised of (1) a waste acrylic yarn fill interior or center portion which has been covered with (2) a four-piece wool or felt batting inner cover which assists in maintaining the proper shape, and which is made of four identical pieces or panels which have been stitched together and which has in turn been covered with (3) a polyester double-knit four-piece outer cover made up of four identically shaped pieces or panels stitched in place. Preferably, simulated lacing is silk screened along an intermediate portion of one of the seams (on two of the panels) so that the ball more closely resembles a conventional football in this sense and raised stitching is used to enhance the throwing characteristics of the ball. Preferably, the two adjoining panels of the cover are overlapped in the region of the simulated lacing and cross-stitching is used to secure the seam to provide an elevated or raised ridge for gripping of the ball to enhance the aerodynamics of the ball when thrown, i.e., to allow a spiral to be thrown.

BRIEF DESCRIPTION OF THE DRAWINGS

FIG. 4 is a view of the ball cover including the polyester double-knit exterior and the wool or felt batting inner cover but turned inside out prior to the stuffing of the ball with the waste acrylic yarn fill.

FIG. 5 is an exterior view of the ball showing the opening through which the waste acrylic yarn fill is stuffed and which will then be closed and to which raised cross-stitching will preferably be applied.

FIG. 6 is a cross sectional view of the ball showing the securing of the seams of the cover and the inner wool or felt batting and the hole through which the waste acrylic yarn fill is inserted.

FIG. 7 is a view showing a preferred alternative for securing the inner wool or felt batting panels to each other in the region of the opening where the waste acrylic yarn is inserted.

DETAILED DESCRIPTION OF THE INVENTION

The present invention is predicated on the discovery that by the proper selection of materials and the proper manufacturing technique, a ball having the general appearance, shape and characteristics of a football can be produced. However, the ball of the subject invention requires less space—a smaller field—in which to play since the ball does not travel as far when kicked or thrown. Additionally, there is less danger to limb and property since the ball is softer and lighter reducing the likelihood of broken windows and damage to individuals struck by the ball.

Figure 3:
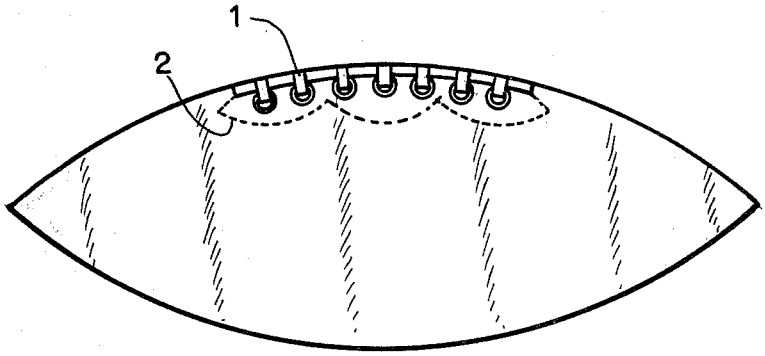
FIG. 3 is a view of one of the four pieces or panels used to prepare the polyester double-knit outer cover. Four substantially identical in shape pieces or panels—the size may be slightly smaller—are used for the wool or felt batting inner cover. The pieces or panels are generally elliptical-in-shape with the edge of the panels preferably converging progressively to a point at the ends. (The panel shown in FIG. 3 shows the simulated lacing appearing on two of the four outer cover panels. The other two may be plain, or other decorative work may be applied to them.)

According to the invention and referring to the drawings, four sections or panels having the general configuration (elliptical shape) shown in FIG. 3 are prepared out of double-knit polyester for the outer cover. Two of these panels preferably have simulated lacing 1 and a border 2 affixed thereon as shown in FIG. 3, preferably by a silk screen process using a textile paint. Correspondingly shaped pieces, but which may have a slightly smaller size, are prepared from a wool or felt batting material for the interior cover. The four panels or pieces of the inner cover and the four pieces or panels of the outer cover are then stitched together with the wool or felt batting on the outside in the manner shown in FIG. 4 leaving a hole two to four inches long along one seam (as shown in FIG. 4) through which the waste acrylic yarn fill can subsequently be inserted. When a simulated lacing is used on two of the outer cover panels as shown in FIG. 3, these two panels together with the corresponding panels for the interior cover are sewn together from the end points of the panels up to about the edge of where the simulated lacing starts leaving an opening in the area of the simulated lacing. The other two panels of the outer cover and the other two panels of the interior cover are sewn to each other and to the panels which have been sewn together leaving the opening at the simulated lacing area. The ball at this stage of manufacture is inside out as shown in FIG. 4. After the stitching of all four seams is completed—three completely and one as shown in FIG. 4 leaving a two to four inch hole along the seam where the simulated lacing has been placed—the ball cover is turned right side out so that the polyester double-knit cover is in its proper position, i.e., as the outside cover of the ball (FIG. 5).

Waste acrylic yarn is then inserted through the hole left in the ball cover, preferably for a junior sized football, e.g., one about 6 to 15 inches in circumference at the center or belly of the ball and about 4 to 8 inches long, in an amount of from 1 to 7 ounces, more preferably 2 to 6. Preferably the waste acrylic yarn fill used in this invention is 100% acrylic waste yarn of 3 or 4 ply having a denier of from about 4 to about 10, preferably about 7, and made up of short pieces from 2 to 5 inches in length, more preferably from about 2½ to about 4 inches in length. The amount of waste acrylic yarn used and the density with which the ball is packed will determine both the hardness of the ball and its weight. Obviously, the size of the ball will be determined by the size of the pieces used for the cover and the wool batting. A full sized football, i.e., one about 11 inches long and about 21.5 inches in diameter at the center or belly, can be prepared if desired using the general technique set out herein. The amount of the waste acrylic yarn fill used will be from about 7 to about 15 ounces. The preferred size for the football, however, is about 15 inches in circumference at the center or belly, and about 8 inches long preferably containing about 4 ounces of waste acrylic yarn fill.

After the ball has been stuffed with the desired amount of waste acrylic yarn fill, the hole in the ball is closed and cross stitches are placed on the ball. These can be applied by actual stitching of heavy-duty thread or alternatively by use of a textile paint to produce a raised or elevated ridge for gripping the ball. A combination of actual cross stitching with a heavy thread and textile paint can also be used. This feature enhances the aerodynamic characteristics of the ball by enabling the passer to throw a spiral. The use of waste acrylic yarn as the fill material has been found to provide a ball having desirable aerodynamic characteristics, but firmer and more durable than the ball prepared using polyester batting, while still being softer than a conventional ball.

Figure 1:
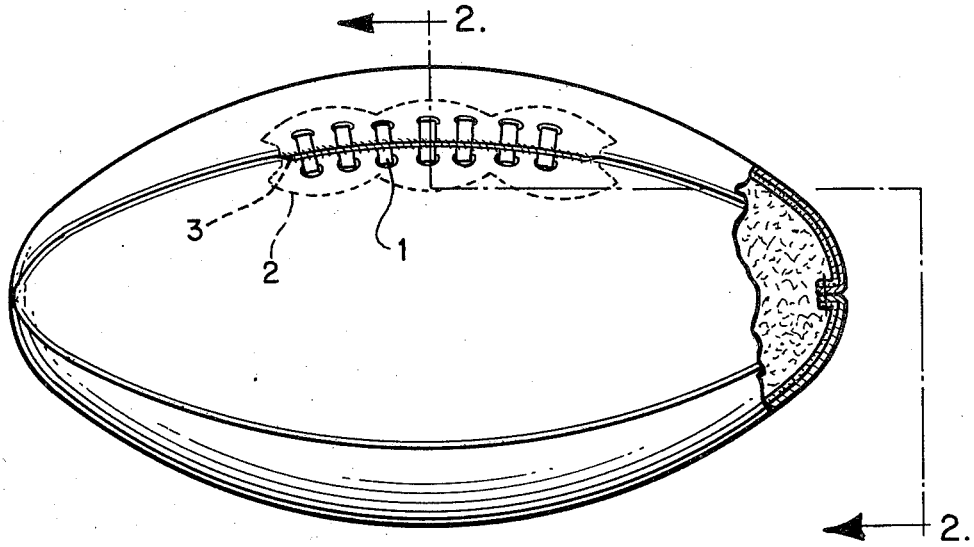
FIG. 1 is a view of the finished ball showing the simulated laces, the stitching, the multiple piece cover and a partial cutaway to show the interior waste acrylic yarn fill and the wool or felt batting inner cover.
Figure 2:
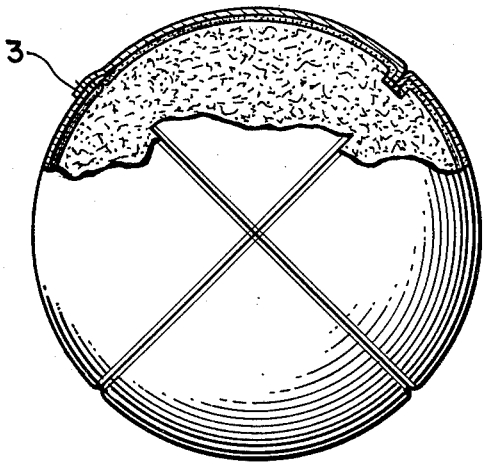
FIG. 2 is a cross sectional view along line 2—2 in FIG. 1 showing the end of the ball and one manner of securing the polyester double-knit cover and the wool or felt batting inner cover. The elevated or raised ridge is also shown in this figure.

In closing the ball, a preferred technique is to secure the two wool for felt batting interior cover panels at the opening by pulling them together and securing them to each other by stitching (as shown in FIG. 7). The two double-knit polyester cover sections or panels at the opening are then overlapped by stretching one over the other (as shown at 3 in FIGS. 1 and 2) and the simulated stitching on the two adjoining outer cover panels is carefully aligned (when multiple color pieces or panels are used, the darker panel is preferably placed over the lighter colored panel) and the cover sewn closed in this overlapped position by cross stitching using an interlocking stitch (buttonhole stitch). When this technique is used the cross stitching to secure the overlapped panels together with the overlapping itself provides the desired elevated or raised ridge for gripping.

To summarize the method of manufacture:

1. The elliptically shaped wool or felt batting inner cover and polyester double-knit outer cover panels or sections are cut out (4 pieces of each). (At this stage the simulated lacing may be applied to two of the outer cover panels, preferably by silk screening and preferably before the panels are cut out.)
2. The panels or sections are sewn together along their edges (with the wool or felt batting inner cover on the outside) leaving an opening—about 2 to 4 inches long—along one seam in the center of the ball. (When simulated laces are placed on two of the exterior panels as shown in FIG. 3, the opening is left on the seam where the simulated stitches will be on the finished ball.)
3. The ball cover is turned right side out and stuffed with the desired amount of waste acrylic yarn fill.
4. The opening through which the fill was inserted is closed, preferably by pulling together the two interior cover panels adjoining the opening and securing them to each other by stitching. The outer two panels are then preferably overlapped (preferably the darker colored panel over the lighter colored panel if multiple colored panels are used) with the simulated laces carefully aligned, and an interlocking cross stitch is used to secure the cover in place.
5. A textile paint may be applied over the opening to create a raised football lace pattern. This is not essential since the overlapped exterior panels and the cross stitching provide a raised or elevated ridge for gripping.
6. Any desired decorative work may be applied to the ball, either at this stage or in stage 1 above, i.e., prior to cutting out the outer cover panels in the silk screening step.

It is apparent from the foregoing that the present invention provides a new and useful ball and method for making the same for use in the conventional American game of football. The present ball can withstand substantial abuse, can be used by beginning players where the use of a conventional hard football would be potentially dangerous to the players, and can be used where space is limited.

It should be understood that various changes and modifications can be made in the details of the procedure, without departing from the scope and spirit of the inventin; and, therefore, the invention is not intended to be limited except as indicated in the amended claims. For example, the seams may be secured by use of an appropriate adhesive rather than stitching. Also, a basketball or soccer ball can be prepared using the general procedure described above. When a basketball or soccer ball is prepared, preferably eight substantially identically-sized pieces will be used to make up both the cover and the inner wool or felt batting covering. Similarly to the procedure outlined above, a hole will be left for stuffing the basketball or soccer ball. However, there is no need for raised or elevated cross stitching to provide the gripping surface for throwing as with the football. The size of the ball, as in the case of a football, will be determined by the size of the pieces or panels of the outer cover and the inner wool or felt batting inner cover. And, the hardness and weight of the basketball or soccer ball will, of course, be determined by increasing or decreasing the amount of waste acrylic yarn fill used to stuff the ball. Preferably, the basketball or soccer ball of the subject invention will weigh less than a conventional basketball or soccer ball, respectively. In any event, they will be softer.

I claim as my invention:

1. A ball comprising:

(a) an interior portion comprised of waste acrylic yarn fill, (b) a wool or felt batting interior cover comprised of four panels or sections, (c) a polyester double-knit outer cover comprised of four panels or sections, each of which are substantially identically shaped and are secured to each other and to said corresponding interior wool or felt batting piece to form seams running the length of the ball, said ball further characterized by an elevated or raised area along an intermediate portion of one of the seams to enable the ball to be thrown in a spiral, said ball having the general appearance, shape and characteristics of a conventional football when thrown or kicked, but being softer and lighter.

2. The ball of claim 1 wherein simulated lacing is present at an intermediate position on each of two adjoining panels of said outer cover and said two adjoining panels are so arranged and constructed as to overlap at the point where said simulated lacing is present to form said raised area while simulating the lacing on a conventional football and secured in that position by cross stitching.

3. The ball of claim 2 wherein said fill is 100% waste acrylic yarn having a denier of from about 4 to about 10.

4. The ball of claim 1 wherein the amount of said waste acrylic yarn fill in the interior portion is from about 1 to about 15 ounces.

5. The ball of claim 4 wherein said fill is present in the interior portion in an amount of about four ounces, the denier of said fiber is about 7 and said ball is about 8 inches long and about 15 inches in circumference at the middle or belly.

6. A spherical ball comprising:

(a) an interior portion comprised of waste acrylic yarn fill;

(b) an 8-piece wool or felt batting interior cover;

(c) an 8-piece polyester double-knit outer cover each of which eight pieces of said polyester double-knit outer cover are substantially identical in size and are secured to each other and to said corresponding interior wool or felt batting piece by stitching.

7. In a ball generally oval in shape in the manner of a conventional football and comprised of an interior structure and a cover, the improvement which comprises:

a cover comprised of four generally ellipticalin-shape cloth panels, including a first panel and a second panel which each have imprinted or affixed thereon simulated laces along the perimeter of one side at an intermediate position to resemble a conventional football's lacing;

said first panel and said second panel positioned adjoining each other with the simulated laces on each of said first panel and said second panel aligned to meet the corresponding simulated laces on the other of said first panel and said second panel;

said first panel and said second panel further positioned as to overlap at the points where said simulated laces are present to form an elevated or raised area;

and said four panels joined to each other along the perimeter of each of said four pieces or panels to form said cover.

* * * * *